United States Patent [19]

Picard

[11] Patent Number: 4,950,095

[45] Date of Patent: Aug. 21, 1990

[54] DENTAL HYGIENE DEVICE

[76] Inventor: Pierre E. Picard, 121, 9th Ave., Sherbrooke, Québec, Canada, J1G 2P9

[21] Appl. No.: 409,330

[22] Filed: Sep. 19, 1989

[51] Int. Cl.[5] ..... A46B 11/00; B43K 29/00

[52] U.S. Cl. ..... 401/191; 401/195; 132/309

[58] Field of Search ..... 401/191, 195, 268, 175; 132/308, 309, 311, 323–325; 222/93

[56] References Cited

U.S. PATENT DOCUMENTS

| | | | |
|---|---|---|---|
| 3,853,134 | 12/1974 | McCord | 401/195 |
| 4,004,597 | 1/1977 | Kupperman et al. | 132/309 |
| 4,467,822 | 8/1984 | Blackwell | 401/175 |
| 4,673,106 | 6/1987 | Fishman | 132/309 |
| 4,693,622 | 9/1987 | Booth | 401/191 |
| 4,787,765 | 11/1988 | Kuo | 401/191 |

*Primary Examiner*—Robert A. Hafer
*Assistant Examiner*—Kerry Owens
*Attorney, Agent, or Firm*—Roland L. Morneau

[57] ABSTRACT

A dental hygiene device comprising a toothpaste compartment a toothbrush compartment and a toothbrush retractable in the latter compartment. A slot is provided in the device to let the toothpaste flow through the bristles while the toothbrush is in its retracted position. A piston arrangement is used to push the toothpaste through the slot.

2 Claims, 4 Drawing Sheets

DENTAL HYGIENE DEVICE

FIELD OF THE INVENTION

The present invention relates to the field of dentistry and more particularly to a personal dental hygiene device adapted to be easily carried and comprising a toothbrush, a toothpaste dispenser and a dental floss dispenser.

BACKGROUND OF THE INVENTION

Proper dental hygiene practice dictates brushing of the teeth after each meal. This practice requires that the necessary implements and supplies be either stored at the location where the user brushes his teeth or be carried to that location. However, it is not always possible to hygienically store the dental hygiene implements. Furthermore, carrying these implements can be both tedious and unhygienic. Prior art devices have been proposed to alleviate the foregoing difficulties. U.S. Pat. Nos. 2,025,591; 4,002,181; 2,253,514; 4,056,110; 3,613,698;, and 4,759,381 are examples of patents disclosing dental hygiene units adapted to be carried on one's person. However, they are either mechanically complex or inefficient.

Furthermore, some of them imply inherent limitations on the type of toothpaste compatible with the system design.

SUMMARY OF THE INVENTION

Accordingly, this invention relates to a dental hygiene device which is compact and adapted to be carried upon one's person.

Another object of this invention is to provide a dental hygiene device having a toothbrush, a toothpaste dispenser, and a dental floss dispenser.

Another object of this invention is to provide a dental hygiene device in which the depleted supply of toothpaste or dental floss may be readily replenished.

Another object of this invention is to provide an ergonomical dental hygiene device which hygienically protects the bristles of the toothbrush when not in use.

Another object of this invention is to provide a dental hygiene device which can easily be dismounted thus allowing easy cleaning of the various components.

A further object of this invention is to provide a dental hygiene device which efficiently dispenses the toothpaste between the rows of bristles extending laterally from the head of the toothbrush.

A still further object of this invention is to provide a dental hygiene device which will conform to conventional forms of manufacturing be of simple construction and easy to use as to provide a dental hygiene device which will be economical, long lasting and relatively trouble-free in operation.

A dental hygiene device for dispensing toothpaste and for housing a toothbrush having a handle, a head projecting at one end of the handle and at least two rows of bristles extending laterally from the head. The dental hygiene device comprises a hollow elongated receptacle with a displaceable cover at one end, a first tubular compartment in the receptacle for receiving toothpaste, a second tubular compartment in the receptacle adjacent the first compartment for housing the toothbrush. The toothbrush is adapted to slide between a first position and a second position, whereby the bristles are fully retracted inside the second compartment in the first position and whereby they are exposed outside of the second compartment in the second position. The device also comprises a dispensing outlet slot extending between the first compartment and the second compartment.

The slot has lips adapted to penetrate partly between the rows of bristles when the toothbrush is in the first position. The dispensing outlet slot is adapted to allow the passage of the toothpaste from the first compartment to the rows of bristles;

The device includes a piston adapted to push the toothpaste in the first compartment towards the slot. The piston has an elongated screw extending axially into the first compartment, a rotating knob secured to one end of the screw and a follower threadedly mounted on the screw for exerting pressure on the toothpaste in the first compartment upon rotation of the knob. The follower has a radial end wall and a circumferential wall adapted to sealingly fit inside the first tubular compartment. Upon rotation of the knob, the toothpaste is dispensed between the bristles located inside the second compartment in the first position before the toothbrush is slidden in the second position for brushing the teeth.

DETAILED DESCRIPTION OF THE INVENTION

Figure 1:
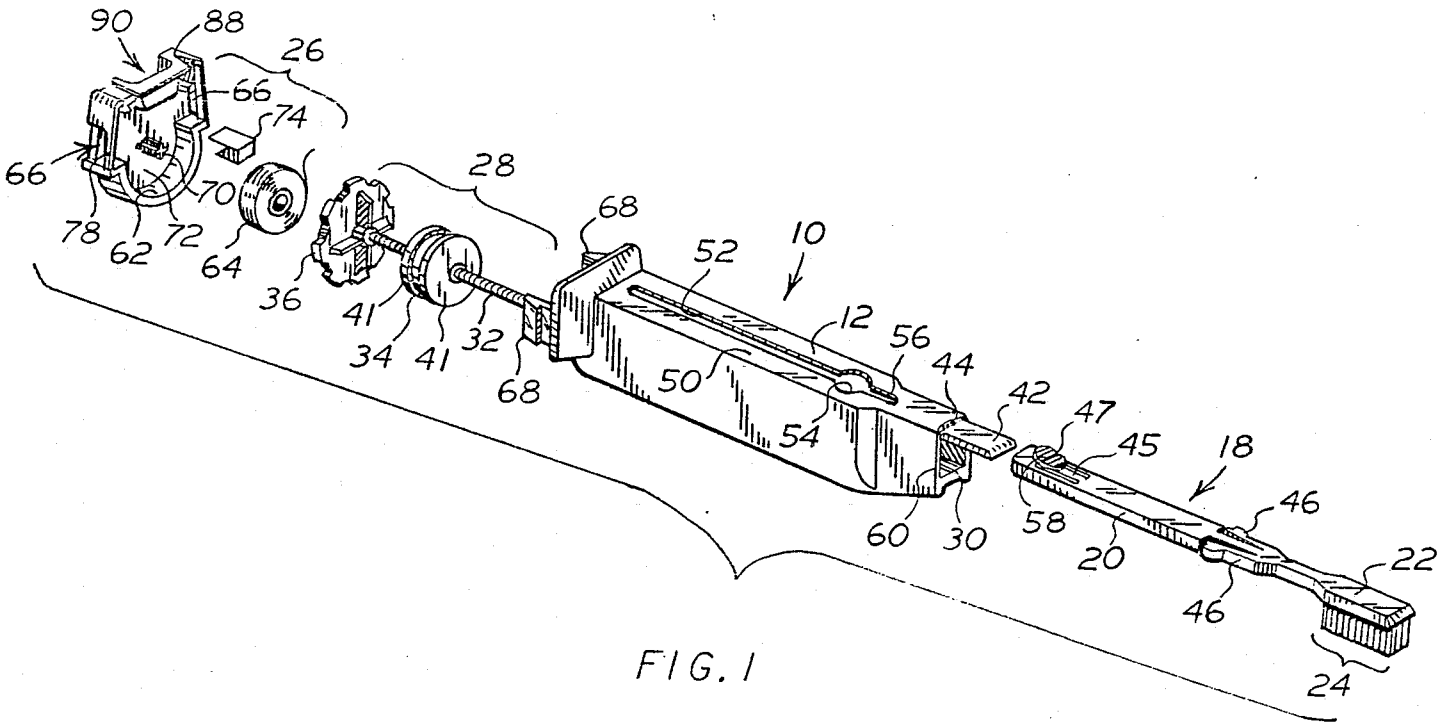
FIG. 1 is a schematic exploded view of the dental hygiene device according to the invention.
Figure 3:
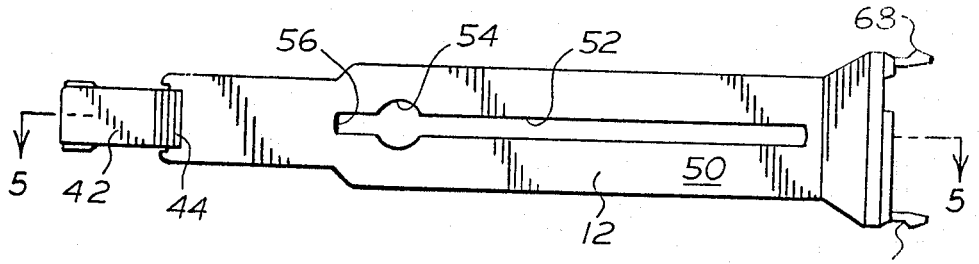
FIG. 3 is a top view of the receptacle shown in FIG. 2.
Figure 2:
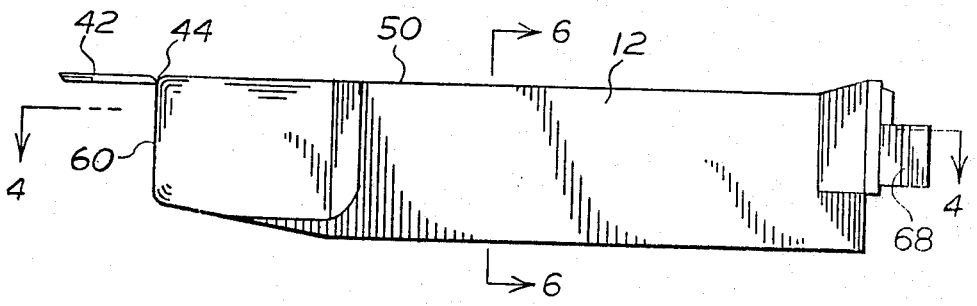
FIG. 2 is a side elevational view of the receptacle shown in FIG. 1.
Figure 4:
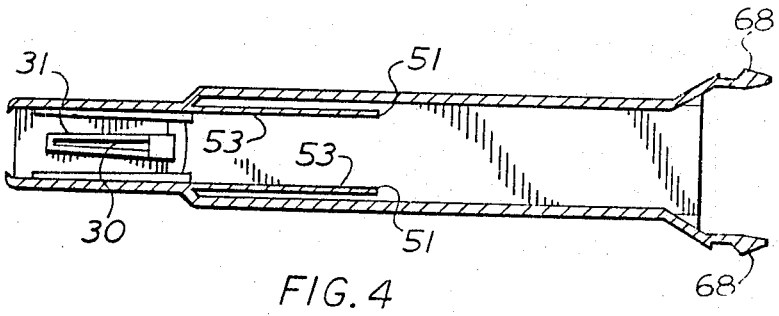
FIG. 4 is a cross-sectional view taken along line A—A of FIG. 2.
Figure 8:
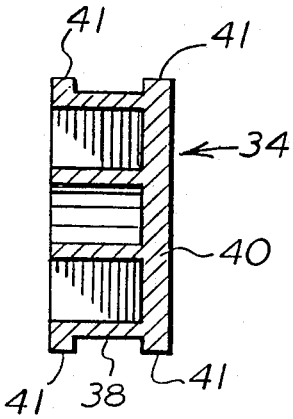
FIG. 8 is a longitudinal cross-sectional view of the follower, shown in FIG. 1.
Figure 7B:
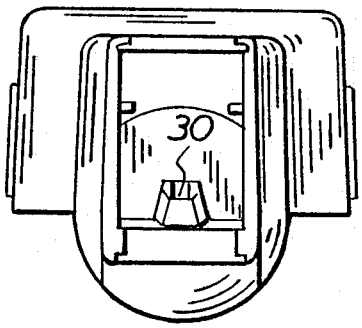
Figure 10:
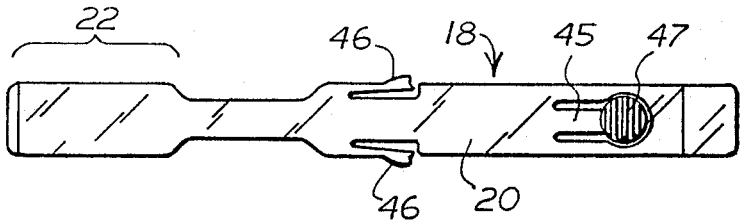
FIG. 10 is a bottom view of the toothbrush shown in FIG. 9.
Figure 9:
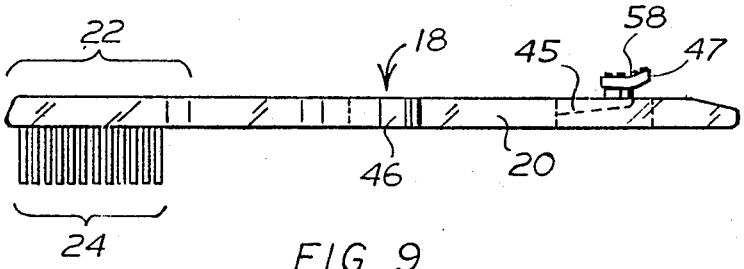
FIG. 9 is an elevational view of the toothbrush shown in FIG. 1.

Referring to the drawings, the dental hygiene device is indicated by the reference numeral 10. The device 10 comprises a hollow elongated receptacle 12 divided into a toothpaste compartment 14 (FIG. 5) and a coaxial toothbrush protective compartment 16. The toothbrush protective compartment 16 is adapted to house a toothbrush 18 (FIG. 1) having a handle 20, a head 22 projecting at one end of the handle 20 and rows of bristles 24 projecting laterally from the head 22. The dental hygiene device 10 also comprises a dental floss dispensing means 26 and a piston means 28 adapted to push the toothpaste towards a dispensing outlet slot 30. The pressure creating means 28 comprises a screw 32 which extends axially into the compartment 14 and which supports a follower 34 adapted to snuggly fit in the compartment 14. A rotating knob 36 is provided at one extremely of the screw 32. Rotation of the knob 36 forces the follower 34 to exert pressure on the toothpaste which is discharged through the dispensing outlet slot 30. As illustrated in FIG. 8, the follower 34 is substantially cylindrical in shape having a circumferential wall 38 and a radial end wall 40. This specific shape was preferred to the disk shaped follower disclosed in U.S. Pat. No. 2,025,591 because with the present embodiment, pressurized toothpaste will exert pressure on the circumferential wall 38 thus providing a sealing action and possibly correcting the small defects such as small ovalness of the circumferential wall 38 which can be caused by the manufacturing process. The follower 34 is also provided with sealing rings 41 formed integral with the follower 34 at both extremities of the circumferential wall 38. The sealing rings 41 serve two distinct functions.

Figure 5:
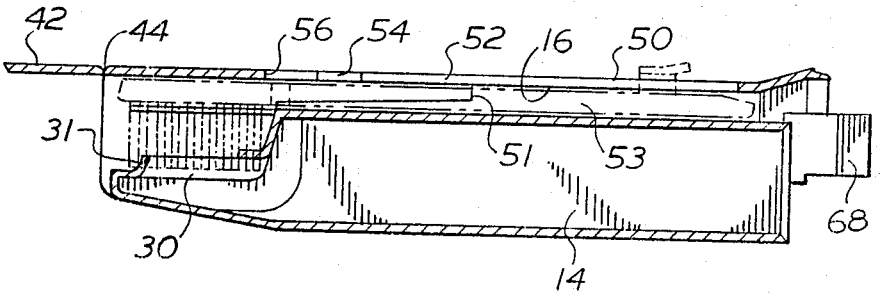
FIG. 5 is a cross-sectional view taken along line C—C of FIG. 3.
Figure 6:
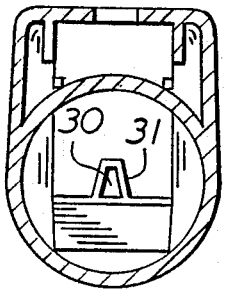
FIG. 6 is a cross-sectional view taken along line D—D of FIG. 2, FIG. *7a* is a rear view of the receptacle shown in FIG. 2, FIG. *7b* is a front view of the receptacle shown in FIG. 2.
Figure 7A:
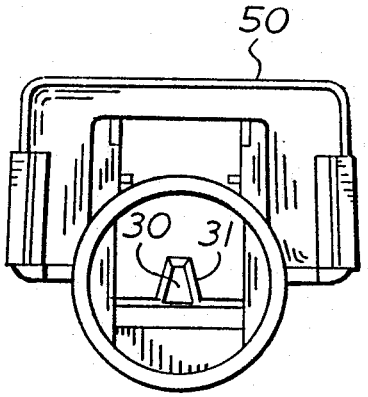
Figure 11:
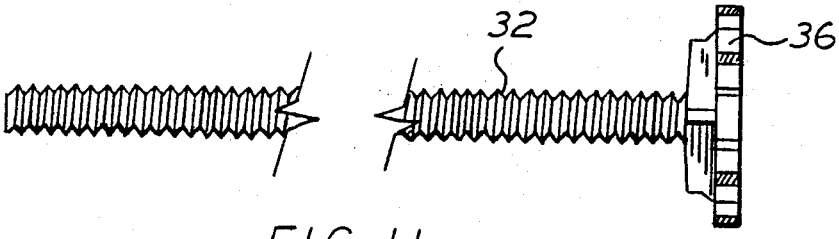
FIG. 11 is an elevational view of the rotational knob and associated screw.

The first of these functions is to provide a sealing action preventing the toothpaste from flowing back behind the follower 34. The second function is to provide friction means between the follower 34 and the toothpaste reservoir compartment 14 therefore ensuring that the the follower 34 will progress forwardly on the threads of the screw 32 upon rotation of the knob 36. As illustrated in FIG. 5, the compartment 16, substantially shaped like the contour of a toothbrush is provided with a cover 42 connected to the compartment 16 by a hinge 44. The dispensing outlet slot 30 links the toothpaste compartment 14 to the toothbrush protective compartment 16. Contrarily to what is disclosed in some of the above-listed patents, the present invention does not merely deliver the toothpaste on the surface of the bristles 24. As illustrated in FIG. 5, the dispensing outlet slot 30 is provided with lips 31 which extend upwardly and penetrate into the bristles when the toothbrush 18 is fully retracted in the protective compartment 16 thus delivering the toothpaste between two rows of bristles and providing a more thorough distribution of the toothpaste through the bristles. The toothbrush 18 is adapted to slide in and out of the toothbrush protective compartment 16. The handle 20 (FIG. 1) of toothbrush 18 has an upwardly slanted spring leg 45 and two sidewardly slanted spring legs 46 formed integral with the handle 20. The spring leg 45 is provided with a protuberant button 47 at its extremity. The toothbrush protective compartment 16 has a top wall 50 provided with an elongated aperture 52.

The longitudinal groove 52 has a broadening 54 near the frontal end. As illustrated in FIG. 5, the upwardly biased spring leg 45 extends through the elongated aperture 52 and the button 47 is located above the top wall 50 of the compartment 16. The diameter of the button is greater than the diameter of the elongated aperture 52 but smaller than the diameter of the broadening 54. In use, the toothbrush 18 is kept in its fully retracted position illustrated in FIG. 5 by the spring legs 46 which releasably abut against an inside edge 51 of a pair of abuting strips 53 extending longitudinally from the front end of the compartment 16. To bring the toothbrush 18 out of the toothbrush protective compartment 16, the user must first lift the cover 42 and then push the button 47 forwardly until it reaches a frontal end 56 (FIG. 5) of the longitudinal groove 52. To facilitate this action, the button 47 is provided with a substantially concave and rugose top surface 58.

As the toothbrush is being pushed forwardly, the spring legs 46 are biased inwardly while overriding the abutting strips 48. When the button 47 reaches the frontal edge 56 of the aperture 52, the sidewardly biased spring legs 46 consequently pass beyond a frontal edge 60 of the toothbrush protective compartment 10 permitting them to relax into a position whereby they abut against the frontal edge 60 thus preventing the unwanted retrieval of toothbrush 18 inside the toothbrush compartment 16. To bring the toothbrush 18 back into the protective compartment 16, the user must press the spring legs 46 inwardly allowing them to laterally clear the frontal edge 60 and push the toothbrush backwards using the button 47. Since the bristles 24 of the toothbrush 18 might become worn-out after a given cycle of use, provision has been made to allow for the replacement of the toothbrush 18. To completely remove the toothbrush 18 out of the toothbrush protective casing 16, the user must slide the toothbrush 18 until the position of the button 47 coincides with position of the broadening 54 (FIG. 5). The user must then press the button 47 downwardly through the broadening until it clears the top surface 50 of the protective chamber and then pull the toothbrush out of the protective casing 16.

Figure 12:
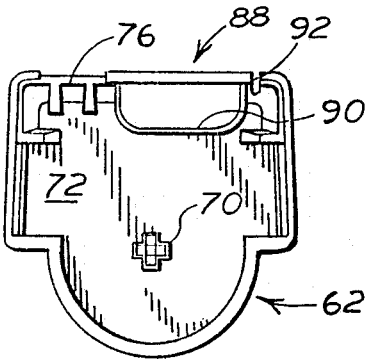
FIG. 12 is a front view of the end cap shown in FIG. 1.
Figure 14:
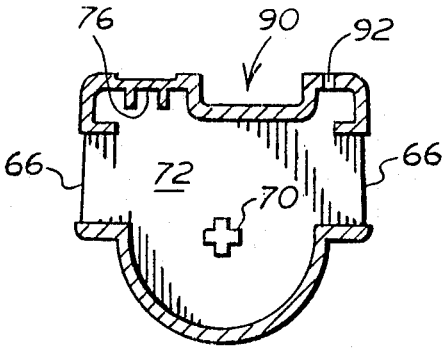
FIG. 14 is a cross-sectional of the end cap taken along line E—E of FIG. 13.

The receptacle 12 is provided with a removable end cap 62 adapted to partially encompass the rotating knob 36 while a portion of its periphery outwardly exceeds between the receptacle 12 and the end cap 62 to allow its rotation. A spool of dental floss 64 is encased in the end cap 62. The end cap 62 has two lateral openings 66. The lateral openings 66 are used in conjunction with a pair of resilient prongs 68 extending integrally from the rearward end of the receptacle 12 to releasably secure in a snap-like fashion the cap 62 to the rearward end of the receptacle 12. The removable end cap 62 is provided with a small shaft 70 which projects axially and inwardly from a backpanel 72 of the end cap 62. The shaft 70 serves two distinct functions. The first of these two functions is to rotatably support the spool of dental floss 64. The second function served by the shaft 70 is to abut against the rotational knob 36 thus preventing an unwanted backward axial translation of the knob 36 and of the screw 32 attached to it. A dental floss cutter 74 such as the ones found in conventional dental floss distrubutor is secured inside a cutter receiving recess 76 provided in the end cap 62. A depleted spool of dental floss 64 can thus easily be replaced by a new spool of dental floss 64. The user must merely remove the endcap 62 and replace the depleted spool by the new one. To remove the end cap 62 the user must press on both resilient prongs 68 until they clear the edges 78 of the lateral openings 66 and then pull the end cap 62. To facilitate this pulling action the top surface 88 (FIG. 12)

of the end cap 62 is formed with a recess 90. The dental floss exits the end cap 62 through a small aperture 92 provided in the top surface 88.

The end piece of the dental floss is normally wrapped around the cutter 74 when not in use, thus overidding the recess 90. The recess 90 therefore also helps the prehension of the floss.

One of the main features of the present invention is that the depleted supply of toothpaste can be readily replenished. To do so, the user first rotates the knob 36 in order to bring the follower 34 to its rearmost position therefore increasing the available space in the toothpaste compartment 18. The user then removes the end cap 62 and pulls on the knob 30 to bring the screw 32 and its associate follower 34 out of the toothpaste compartment 18.

Toothpaste coming from a conventional toothpaste dispenser is then injected into the toothpaste compartment before putting the removed parts back together. Since the present dental hygiene device is easy to dismantle, it is also easy to clean as all dismantled parts can be soaked in lukewarm water before being put back together.

Figure 15:
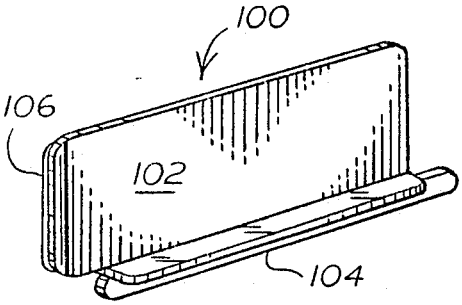
FIG. 15 is a perspective view of a slot blocking element.
Figure 13:
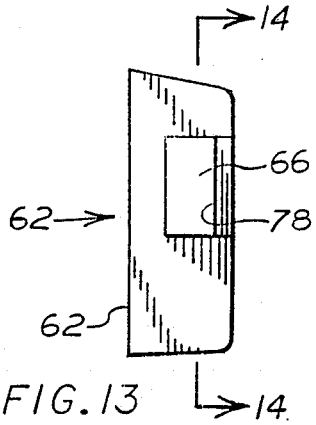
FIG. 13 is a side view of the end cap shown in FIG. 12.

FIG. 15 illustrates a blocking element 100 adapted to be partly introduced in the slot 30 for preventing the toothpaste to escape the toothpaste compartment 18 and to unintentionally run through the bristles. The element 100 comprises a blade 102 which is adapted to be held by the fingers, and a runner 104 adapted to penetrate into the slot 30. The element 100 is pulled by holding the protuberances 106 at one end of the blade 102. The blocking element is mainly intended as a safety measure before the toothbrush is used for the first time.

I claim:

1. A dental hygiene device for dispensing toothpaste and for housing a toothbrush having a handle, a head projecting at one end of the handle and at least two rows of bristles extending laterally from said head, said dental hygiene device comprising:

a hollow elongated receptacle having a displaceable cover at one end and a removable end cap at the other end;

a first tubular compartment in said receptacle for receiving toothpaste;

a second tubular compartment in said receptacle adjacent said first compartment for housing said toothbrush, said second compartment having a protruding section recessed in front of said first compartment for receiving said head and said bristles, said toothbrush being adapted to slide between a first position whereby said bristles are fully retracted inside said protruding section of said second compartment and a second position whereby said bristles are exposed outside of said second compartment, said second compartment further having an external wall provided with an elongated aperture, an upwardly slanted spring leg extending from the handle of said toothbrush, said spring leg having a protuberant button at its upper end and adapted to extend through said elongated aperture for sliding said toothbrush between said first position and said second position, said elongated aperture being narrower than the width of said protuberant button and having a broadening larger than the width of said button, whereby said protuberant button is adapted to be pushed downwards through said broadening so that said upwardly slanted spring leg clears said external wall allowing said toothbrush to be ejected from said second compartment, said handle of said toothbrush having two lateral resilient legs, said second tubular compartment having an opening providing with an outer edge for allowing the toothbrush to slide out of the second compartment, said second compartment having two internal longitudinal abutting strips, said strips being secured at one end to said second compartment and laterally flexible at the other end, whereby when said toothbrush is in said first position, said resilient legs releasably abut against said other end of said abutting strips for preventing an unwanted sliding movement of said toothbrush towards said second position and whereby said resilient legs releasably abut against said outer edge of said second compartment when said toothbrush is in said second position preventing an unwanted retraction of said toothbrush.

2. A device as recited in claim 1, wherein said removable cap at the other end of said receptacle is adapted for housing a reel of dental floss, said removable end cap having a back panel, circumferential wall, a small shaft extending axially and inwardly from said back panel for rotatably supporting said reel of dental floss, an aperture through said circumferential wall for distributing said dental floss and cutting means for cutting said dental floss, a pair of resistant prongs mounted on said receptacle and extending externally at the end of said receptacle adjacent the end cap, said circumferential wall of said end cap having a pair of corresponding lateral openings for allowing insertion of said prongs and releasably engaging said end cap to said adjacent end of said receptacle, said end cap being releasable by manual pressure on said prongs.

* * * * *